US007412971B2

(12) United States Patent
Stewart

(10) Patent No.: US 7,412,971 B2
(45) Date of Patent: Aug. 19, 2008

(54) SELECTIVELY DETACHABLE HELIX RING FOR A FUEL INJECTOR

(75) Inventor: Ted E Stewart, Jacksonville, FL (US)

(73) Assignee: Advanced Global Equities and Intellectual Properties, Inc., Atlantic Beach, FL (US)

( * ) Notice: Subject to any disclaimer, the term of this patent is extended or adjusted under 35 U.S.C. 154(b) by 228 days.

(21) Appl. No.: 11/044,991

(22) Filed: Jan. 27, 2005

(65) Prior Publication Data

US 2006/0162703 A1 Jul. 27, 2006

(51) Int. Cl.
*F02M 37/04* (2006.01)

(52) U.S. Cl. ..... 123/500; 123/495; 417/494

(58) Field of Classification Search ..... 123/500, 123/501, 507, 508, 495, 506, 372, 373; 417/454, 417/494, 499

See application file for complete search history.

(56) References Cited

U.S. PATENT DOCUMENTS 2,564,830 A * 8/1951 Bremser ..... 417/494
3,624,823 A * 11/1971 Staudt et al. ..... 417/454
4,565,320 A * 1/1986 Taniguchi et al. ..... 239/90
4,587,940 A * 5/1986 Schmid ..... 123/503
4,592,323 A * 6/1986 Vest ..... 123/362
4,625,700 A * 12/1986 Elsbett et al. ..... 123/500
4,754,737 A * 7/1988 Ishida et al. ..... 123/500
4,793,043 A * 12/1988 Mathews et al. ..... 29/888.021
4,881,506 A * 11/1989 Hoecker ..... 123/503
5,839,414 A * 11/1998 Klinger et al. ..... 123/467
6,763,810 B1 * 7/2004 Jones ..... 123/500
6,799,561 B2 * 10/2004 Stewart et al. ..... 123/500

* cited by examiner

*Primary Examiner*—Carl S Miller
(74) *Attorney, Agent, or Firm*—Steven Schmid

(57) ABSTRACT

Disclosed is a fuel injection mechanism for regulating the volume of fuel injected into a cylinder comprising a selectively detachable helix ring configured to be removably affixed to an outside diameter of a plunger. The selectively detachable helix ring includes a ridge that has at least one helix angle. The helix angle is associated with a throttle position of the mechanism.

9 Claims, 5 Drawing Sheets

SELECTIVELY DETACHABLE HELIX RING FOR A FUEL INJECTOR

FIELD OF THE INVENTION

The present invention generally relates to a fuel injection system and more specifically the present invention relates to detachable helix rings fitted to a plunger of a fuel injector.

BACKGROUND

Fuel injectors for both diesel and gasoline engines have various parts that often show wear and impede the performance of the injector before other injector parts show wear. Such fuel injectors are usually, but not always located and seated in a tapered hole in the center of a cylinder head. The upper external working parts of the injector are lubricated by oil from the end of the injector rocker arm adjusting screw. Most of the internal working parts are lubricated and cooled by the flow of fuel oil through the injector.

One of the internal working parts subject to wear is the plunger. The plunger is responsible for the proper atomization of the fuel which is accomplished by the high pressure created during the downward stroke of the plunger, which forces the fuel past a valve and out through spray holes in the injector tip. The plunger is placed in motion within the fuel injector by an engine cam acting through a rocker arm and plunger follower. Rotation of the plunger is accomplished by a rack and gear system linked to the engine governor that controls the quantity of fuel to be injected into the cylinder during each stroke.

The plunger includes helices formed near the bottom of the plunger to control the opening and closing of the fuel ports within the bushing in which the plunger operates. The helices are typically machined into the outer circumference of the plunger surface. As the plunger moves past the fuel ports the edges of the helices tend to wear. Typically, the wear results in rounded edges that retard the performance of the engine. Additionally, the profile or helix angle of the helix cannot be changed with changing the plunger.

Thus, what is needed is a method and apparatus for providing a helix that is durable and capable being changed without the need for replacing the plunger.

SUMMARY

The present invention generally relates to fuel injectors and in particular the invention relates to a detachable helix ring for a plunger. The helix ring is configured to fit on to and around the plunger creating ridge portions defining a channel around the outer circumference of the plunger surface. The detachable helix rings replace the need for machining a channel along the circumference of the plunger. Furthermore, helixes with worn ridges can be replaced without the need for replacing the entire plunger. Additionally, the helixes can be interchanged to improve either fuel consumption or emissions.

The fuel injection mechanism for regulating the volume of fuel injected into a cylinder of the present invention comprises a selectively detachable helix ring configured to be removably affixed to an outside diameter of a plunger. The selectively detachable helix ring includes a ridge that has at least one helix angle. The helix angle is associated with a throttle position of the mechanism.

In greater detail, the selectively detachable helix ring includes opposed first and second ridges defining a channel therebetween encircling an axial portion of an outside diameter of the plunger. The selectively detachable helix ring includes an inner diameter and an outer diameter, wherein the inner diameter may include a protrusion operatively configured to fit within a groove located on the outside diameter of the plunger. The helix ring may be formed from spring steel and plated with chrome much like an engine piston ring.

In an additional embodiment, the selectively detachable helix ring comprises an expandable ring and can include at least two selectively detachable helix rings. The two helix rings may be affixed to the outside diameter of the plunger in an opposed configuration. The opposed helix rings define a channel between them on the outer circumference of the plunger. Additionally, a single helix ring may have opposed ridges that define a channel about the outer circumference of the plunger. The ridges formed at the edges of the helix rings may form an angle respective to the outside diameter of the plunger that is less than 90°.

A further embodiment includes a fuel injection mechanism for regulating the volume of fuel injected that includes a selectively detachable helix ring operatively configured to be removably affixed to an outside diameter of a plunger. The selectively detachable helix ring includes a ridge having at least two helix angles, wherein the helix angles are associated with separate throttle positions of the mechanism.

An additional embodiment includes a fuel injection mechanism for regulating the volume of fuel injected having a plunger with a groove substantially encircling an axial portion of an outside diameter of the plunger. The mechanism further includes a selectively detachable helix ring operatively configured to be removably affixed to an outside diameter of a plunger, wherein the helix ring is an expandable ring and the ring includes a protrusion operatively configured to fit within the groove located on the outside diameter of the plunger.

A further embodiment includes a diesel engine having a fuel system wherein the fuel system includes a plurality of cylinders. A plurality of fuel injection mechanisms is seated in the respective cylinders and includes a body, a rotatable plunger slidably fitting within a bushing, and a nozzle tip. The engine further includes a rack and governor constructed and arranged to control rotation of the plunger and a fuel supply line to supply fuel to the injection mechanisms with a fuel return line to return fuel to a fuel supply tank cooperating with the engine. Additionally, a selectively detachable helix ring is operatively configured to be removably affixed to an outside diameter of the plunger.

DRAWINGS

DETAILED DESCRIPTION

Disclosed is a fuel injection mechanism for regulating the volume of fuel injected into a cylinder. The fuel injection mechanism includes a selectively detachable helix ring. The selectively detachable helix ring is configured to be removably affixed to an outside diameter of a plunger for use in a fuel injector or fuel injection pump.

In greater detail, the selectively detachable helix ring includes a ridge that has at least one helix angle. The ridge defines a fuel channel on the outer circumference of the plunger. The helix angle is associated with a throttle position of the mechanism. Throttle positions associated with the helix angle include idle and full throttle. Additionally, varying helix angles can be used to optimized injection timing as is illustrated in U.S. Pat. No. 6,799,561 whose contents are incorporated herein by reference in their entirety.

Referring now in greater detail to the drawings in which like numerals indicate like parts throughout the several views, FIGS. 1-5 depict the selectively detachable helix ring 2(*a-b*) in various embodiments of the present invention.

Figure 1:
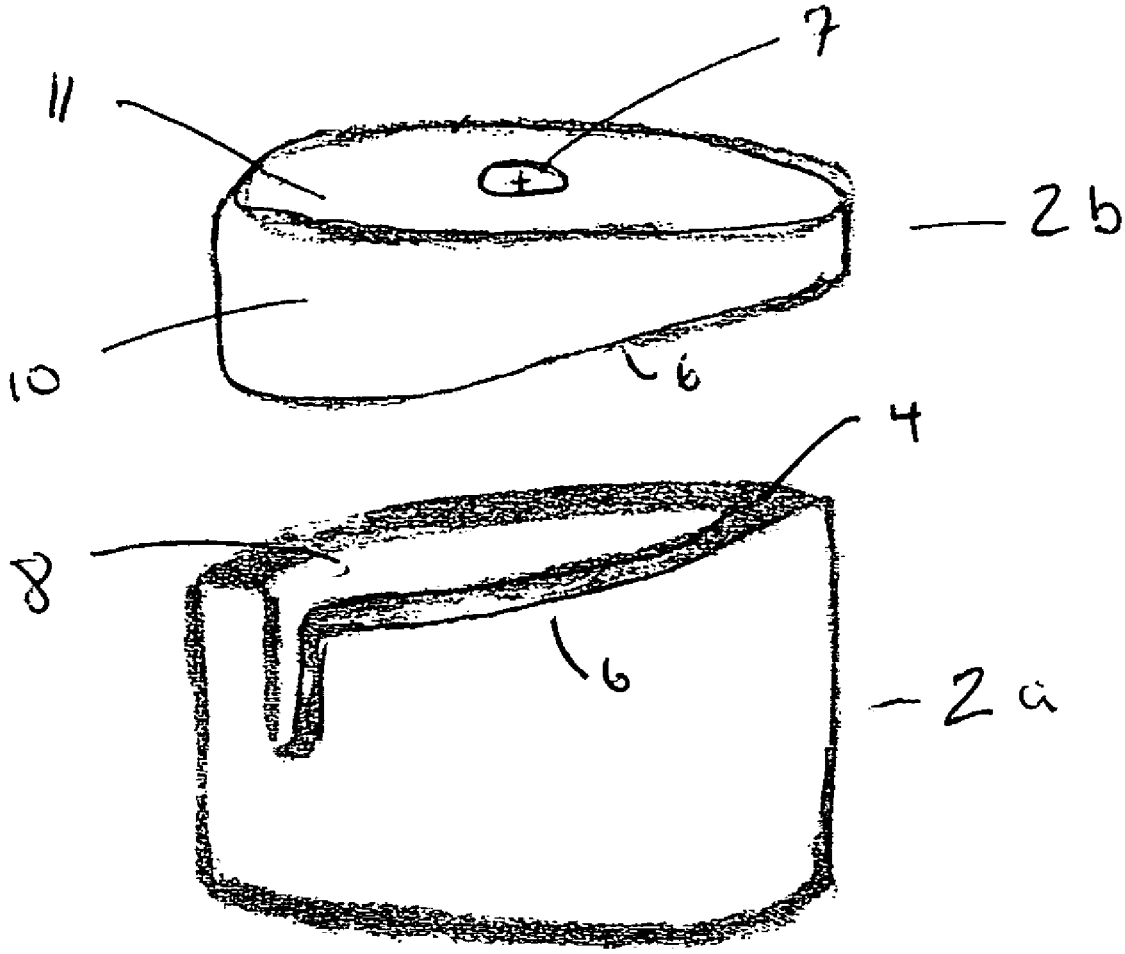
FIG. 1 illustrates a side view of the upper and lower helix rings depicting both the ridge and helix angle.

As indicated in FIG. 1, the selectively detachable helix ring 2(*a-b*) is generally depicted as having a ridge 4 defined by the circumference of the helix ring 2(*a-b*) that is perpendicular to the outer surface of a plunger 12 to which the ring may be selectively attached for defining a channel 26 within the outer surface of the plunger 12. While not shown, the bottom helix ring 2*b* has a ridge 4 along the helix angle 6. Furthermore, the helix ring 2(*a-b*) comprises a helix angle 6 associated with a throttle position of the mechanism. The helix ring 2(*a-b*) has an inner diameter 8 and an outer diameter 10. The inner diameter 8 of the helix ring 2(*a-b*) may have a smooth bore or have various protrusions. In the smooth bore embodiment, the helix ring 2(*a-b*) may be attached to the plunger 12 by most any known methods including by way of example adhesives, welding and friction fit.

Figure 5:
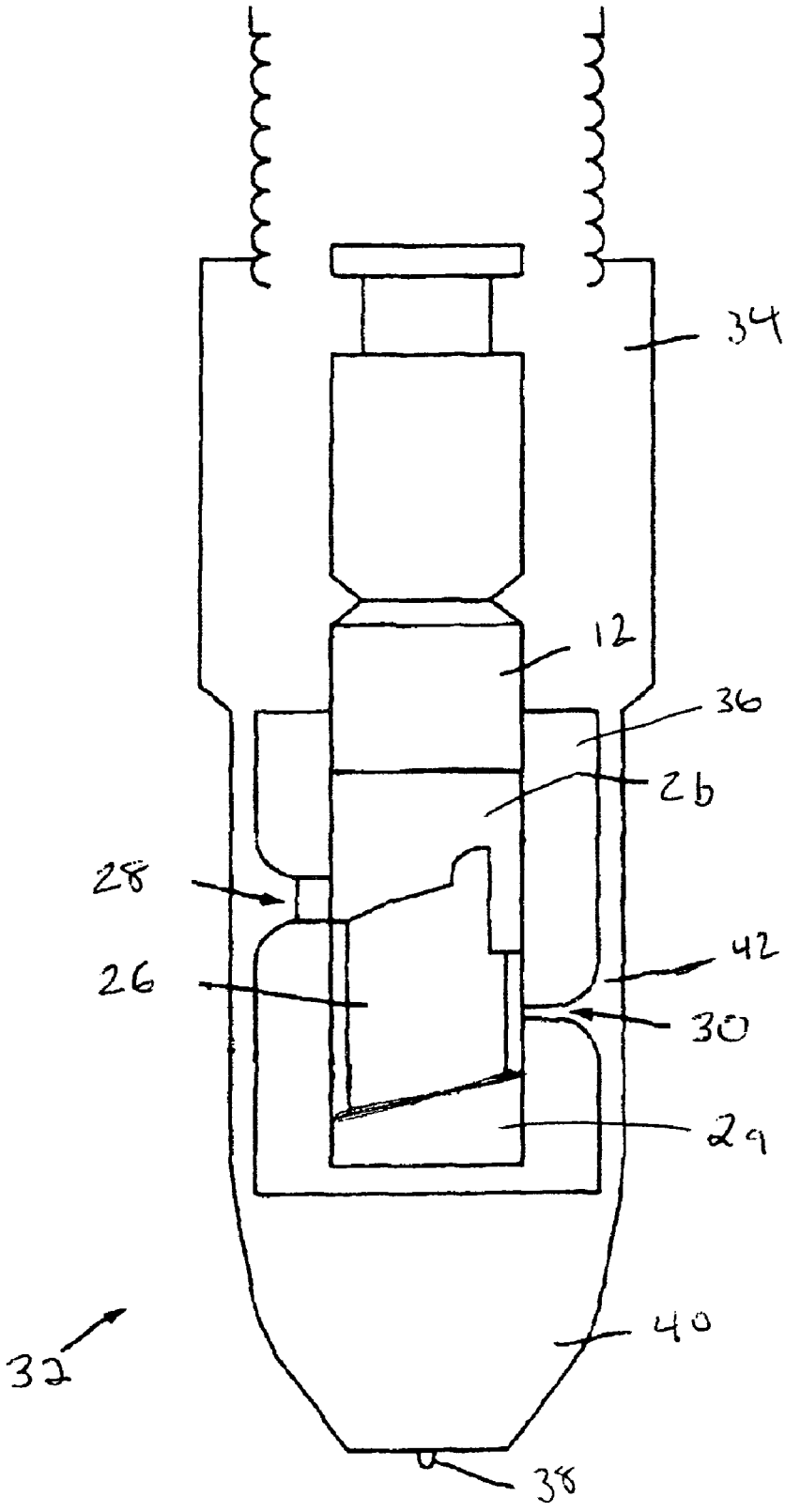
FIG. 5 is a partial cutaway view of a fuel injector having selectively detachable helix rings attached to the plunger.

The helix ring 2(*a-b*) can function as an upper helix ring 2*b* and a bottom helix ring 2*a*. The top helix ring 2*b* cooperates with the initial fuel supply or upper port 28 of the fuel injector 32 as shown in FIG. 5. The bottom helix ring 2*a* cooperates with the lower port 30 as also shown in FIG. 5. The bottom helix ring 2*b* may have an upper lip portion 11 that caps the top portion 13 of the plunger 12. The upper lip portion 11 of the bottom helix ring 2*b* may have a fuel supply hole 7 substantially centered in the lip portion 11. The helix ring 2(*a-b*) may formed from most any durable material that can perform in the environment of the fuel supply system. Example materials include various metals such as spring steel, ceramics and polymeric materials. The helix ring 2(*a-b*) may also have a coating such as chromium or titanium.

Figure 2:
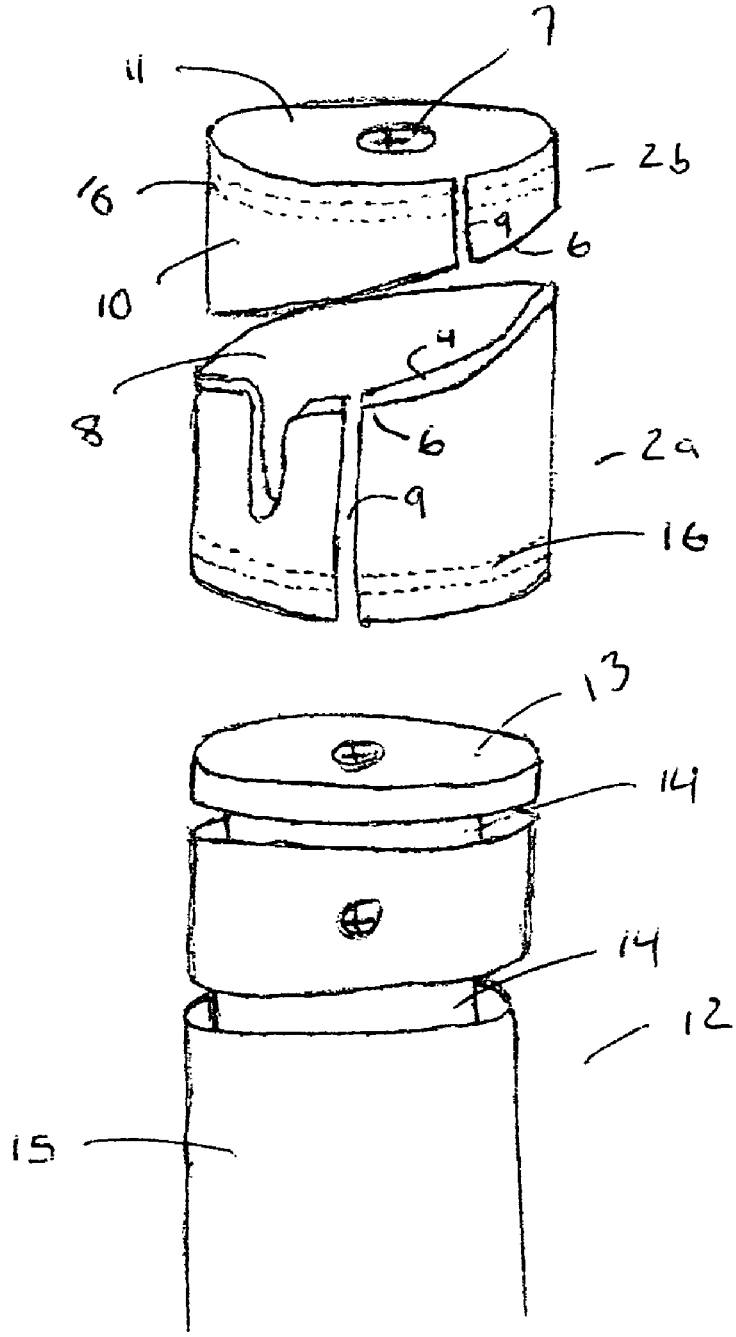
FIG. 2 depicts an embodiment of the fuel injection mechanism wherein the helix rings are attached to a plunger by protrusions fitting within grooves of the plunger and expandable helix rings.

Referring now to FIG. 2, there is disclosed a two-piece embodiment of the fuel injection mechanism having protrusions 16 which are designed to cooperate with grooves 14 carved within the outside diameter 15 of the plunger 12. By way of example, the grooves 14 may be machined within the outside diameter 15 of the plunger 12 or the grooves 14 may be cast when the plunger 12 is formed. Furthermore, the helix ring 2(*a-b*) may be an expandable ring and may be applied in the same manner as an engine's piston ring. In the expandable ring embodiment, the helix ring 2(*a-b*) includes an expansion slit 9 whereby the ring may be expanded to fit over and around the plunger 12 and the protrusions 16 may then rest within the grooves 14 of the plunger 12 to lock in place the helix ring 2(*a-b*).

Figure 3:
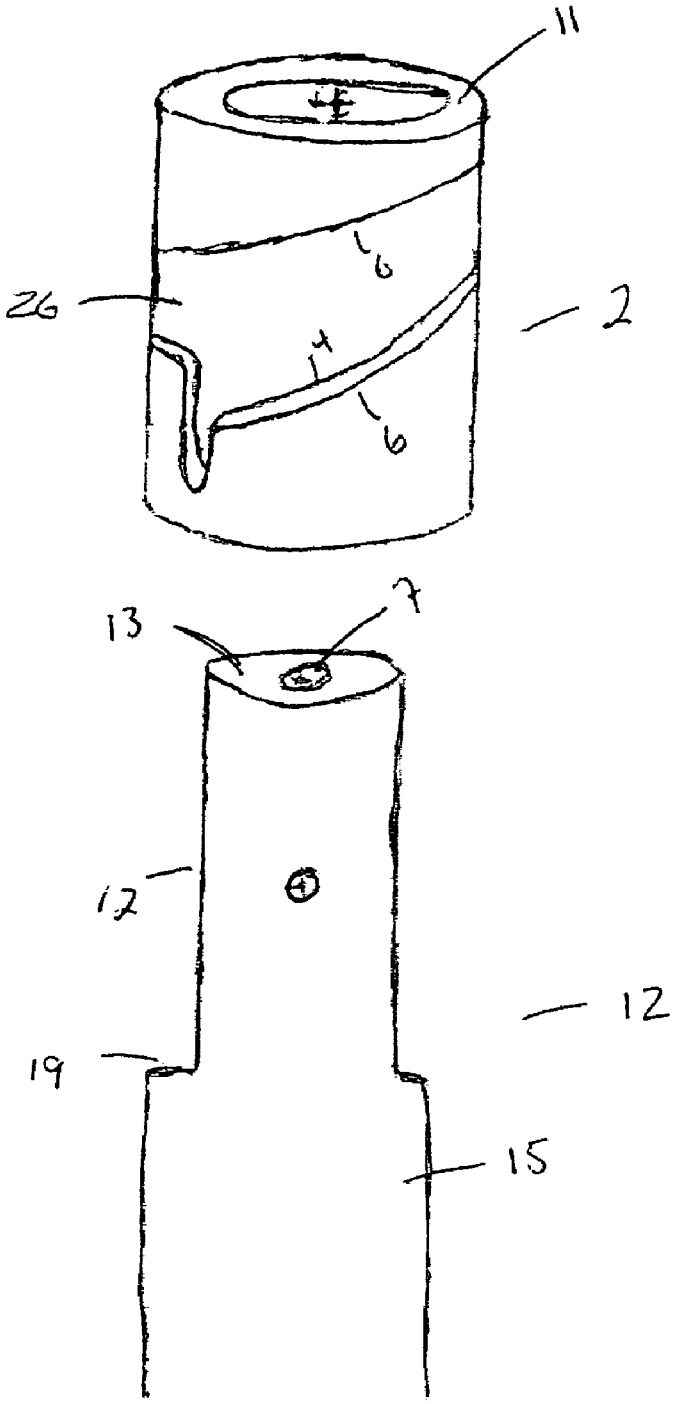
FIG. 3 illustrates single piece embodiment of the fuel injection mechanism wherein the helix ring fits over a post of the plunger.

FIG. 3 depicts an embodiment of the fuel injection mechanism wherein the helix ring 2 is a single unit having both a top and bottom helix angle 6 formed in the same ring defining a channel 26 therebetween. The single unit embodiment may be attached to the plunger 12 by any of the means previously mentioned such as an expansion ring or friction fit. In one embodiment the single unit helix ring 2 can slip over a post 17 section of the plunger 12 and rest on shoulders 19 of the plunger 12.

Figure 4:
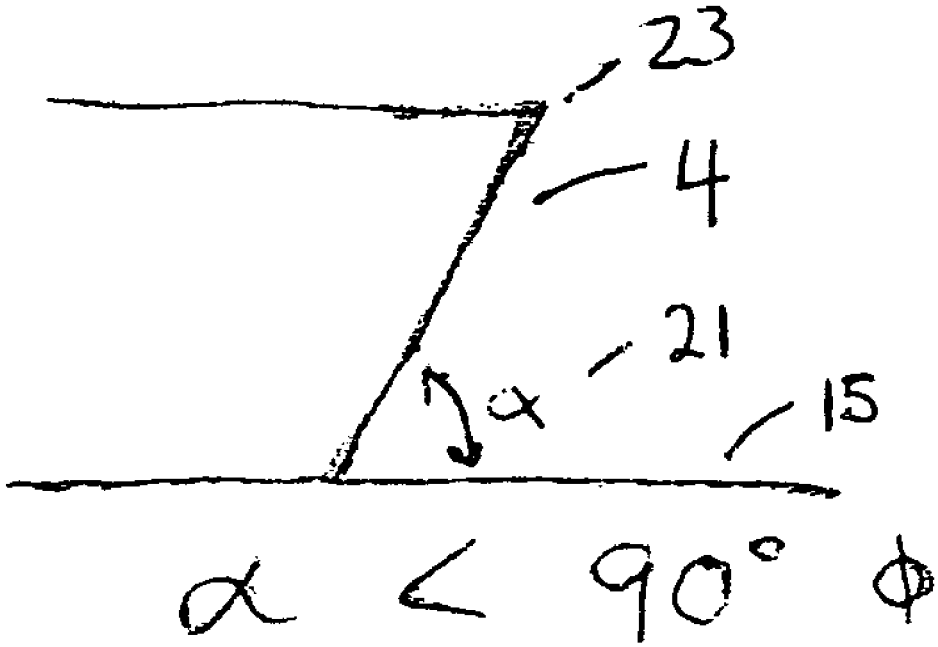
FIG. 4 shows an angle theta creating a leading edge of the helix ring wherein the angle theta is less than 90°.

FIG. 4 illustrates an angle (theta) 21 in the edge 4 of the helix ring 2(*a-b*). The angle 21 is less then 90° relative to the outer circumference 15 of the plunger 12. The inward slope of the angle 21 towards the outer circumference 15 of the plunger 12 creates a sharp leading edge 23. This sharp leading edge 23 can be hardened to prevent wear on the helix ring 2(*a-b*). Furthermore, the sharp leading edge 23 prevents wear on the helix ring 2(*a-b*) from impeding the performance of the ring 2(*a-b*).

FIG. 5 is a partially cutaway cross-sectional view of a fuel injector 32 according to an embodiment. The fuel injector 3 may be an injector for a fuel system of an engine, such as a diesel engine manufactured by GM EMD (General Motors Electro-motive Division). EMD-type engines employ mechanical control of injection timing and may be implemented effectively in various settings. For example, locomotive (line-haul, switcher, passenger, or road), marine propulsion, offshore- and land-based oil well drilling rigs, stationary electric power generation, nuclear power generating plants, and pipeline and dredge pump applications. In one embodiment, injector 32 is implemented in an EMD 567, 645, or 710 series engine.

FIG. 5 depicts a unit injector and associated plungers for EMD-type engines. However, the helix rings 2(*a-b*) may be similarly applied to engines that employ fuel injection pumps, such as diesel engines manufactured by GE Transportation Systems, including the GE 7FDL and 7HDL engines, and diesel engines manufactured by ALCO. In such engines, each fuel injection pump includes a similar plunger that supplies fuel to an injector via a high-pressure fuel line.

The fuel injector 32 includes a body 34, a plunger 12, a housing nut 42, a bushing 36, a nozzle tip 40, and spray holes 38. Other components of injector 32 are not shown in FIG. 5 and are known in the art. The fuel injector 32 is located and seated in a hole of a cylinder head of an engine fuel system. Plunger 32 slidably fits within bushing 36. The bushing 36 includes an upper port 28 and a lower port 30. The upper port 28 and lower port 30 are pathways for fuel. The amount of fuel injected into a cylinder depends on the extent to which the ports are closed.

The specific form of plunger 12, including diameter, roundness, and straightness thereof, may vary depending on the implementation. Diameters of plungers may vary depending on the amount of fuel that is needed for injection. For example, the plunger 12 may have a diameter of between about 8 and 22 mm. Materials for the plunger 12 may be chosen to prevent the plunger 12 from substantial wear, thus to prevent performance of the plunger 12 from being degraded. The plunger 12 may be formed of bearing quality or high alloy steel, such as a chromium/nickel alloy. By way of example, the steel may conform to the 51501 or 52100 specifications of the Society of Automotive Engineers (SAE).

As depicted in FIG. 5 the plunger 12 includes an upper selectively detachable helix ring 2*b* and a lower selectively detachable helix ring 2*a*. Upper helix ring 2*b* and lower helix ring 2*a* determine the opening and closing of upper port 28 and lower port 30 of bushing 36. The upper helix ring 2*b* determines when injection starts, and lower helix ring 2*a* helps determine when injection ends. As such, the helix rings determine the volume of fuel that is injected.

The upper helix ring 2*b* and the lower helix ring 2*a* include ridges 4 that define a shallow fuel channel 26 encircling an axial portion of plunger 12. The upper helix ring 2*b* includes a ridge 4 portion that slopes or forms a helix angle 6 from a first point on the plunger surface towards a second point on the plunger surface. Sloping may involve one or more instances of ascending, descending, or neither ascending nor descending, between the first and second points. In some embodiments, the first point may be associated with an idle throttle position of injector 32, and the second point may be associated with a full throttle position of injector 32. Changes in slope of the helix angle 6 imply that the ridge 4 may include multiple segments of a predetermined length and/or height. In some embodiments, changes in slope may occur gradually such that one or more portions of the helix angle 6 are curved in perspective; for such embodiments, segments of the helix angle 6 may be extremely short. In other embodiments, changes in slope may be abrupt such that the helix angle 6 appears to have one or more clearly distinct portions.

The plunger 12 may be given a constant stroke reciprocating motion by an injector cam acting through a rocker arm and plunger follower (not shown). An adjusting screw at the end of the rocker arm may set timing of the injection period during the plunger stroke. The plunger 12 may be rotated via a rack and gear (not shown), as known in the art. Rotation of the plunger 12 regulates the time that the upper port 28 and the lower port 30 may open and close during the downward stroke, thus determining the quantity of fuel injected into the cylinder. As plunger 12 is rotated from idle throttle position to full throttle position, the pumping part of the stroke is lengthened, injection is started earlier, and more fuel is injected.

Proper atomization of fuel is accomplished by the high pressure created during the downward stroke of plunger 12, which forces fuel past a needle valve (not shown), causing the needle valve to lift, thus forcing fuel out through spray holes 38 in nozzle tip 40 of injector 32.

While Applicants have set forth embodiments as illustrated and described above, it is recognized that variations may be made with respect to disclosed embodiments. Therefore, while the invention has been disclosed in various forms only, it will be obvious to those skilled in the art that many additions, deletions and modifications can be made without departing from the spirit and scope of this invention, and no undue limits should be imposed except as set forth in the following claims.

The invention claimed is:

1. The diesel engine comprising:

a fuel system, the fuel system including, a plurality of cylinders;

a plurality of fuel injection mechanisms seated in respective cylinders, each injection mechanism including a body, a rotatable plunger slidably fitting within a bushing, and a nozzle tip;

a selectively detachable helix ring operatively configured to be removably affixed to an outside diameter of the plunger;

a rack and governor constructed and arranged to control rotation of the plunger;

a fuel supply line to supply fuel to the injection mechanisms;

a fuel return line to return fuel to a fuel supply tank cooperating with the engine; and wherein the selectively detachable helix ring includes an inner diameter and an outer diameter, wherein the inner diameter includes a protrusion operatively configured to fit within a groove located on the outside diameter of the plunger.

2. The fuel injection mechanism for regulating the volume of fuel injected comprising:

a selectively detachable helix ring operatively configured to be removably affixed to an outside diameter of a plunger, wherein the selectively detachable helix ring includes an inner diameter and an outer diameter, wherein the inner diameter includes a protrusion operatively configured to fit within a groove located on the outside diameter of the plunger.

3. The fuel injection mechanism for regulating the volume of fuel injected comprising:

a selectively detachable helix ring operatively configured to be removably affixed to an outside diameter of a plunger, the selectively detachable helix ring includes a ridge having at least two helix angles, wherein the helix angles are associated with separate throttle positions of the mechanism; and wherein the selectively detachable helix ring includes an inner diameter and an outer diameter, and wherein the inner diameter includes a protrusion operatively configured to fit within a groove located on the outside diameter of the plunger.

4. A fuel injection mechanism for regulating the volume of fuel injected comprising:

a plunger having at least one groove substantially encircling an axial portion of an outside diameter of the plunger;

a selectively detachable helix ring operatively configured to be removably affixed to an outside diameter of a plunger, wherein the helix ring is an expandable ring and the ring includes a protrusion operatively configured to fit within the groove located on the outside diameter of the plunger.

5. The fuel injection mechanism of claim 4, wherein the selectively detachable helix ring is formed from spring steel.

6. The fuel injection mechanism of claim 4, further including a first and a second selectively detachable helix ring opposably affixed to the outside diameter of the plunger.

7. The fuel injection mechanism of claim 6, wherein the first selectively detachable helix ring includes a first ridge and the second selectively detachable helix ring includes a second ridge, wherein the first ridge and the second ridge are opposed and define a channel therebetween.

8. The fuel injection mechanism of claim 4, wherein the selectively detachable helix ring includes a ridge, the ridge forming an angle respective to the outside diameter of the plunger that is less than 90°.

9. The fuel injection mechanism of claim 4, wherein the selectively detachable helix ring includes opposed first and second ridges defining a channel therebetween encircling an axial portion of the outside diameter of the plunger.

* * * * *